US006099248A

United States Patent [19]

Mumm et al.

[11] Patent Number: 6,099,248

[45] Date of Patent: Aug. 8, 2000

[54] OUTPUT STAGE FOR AN AXIAL-FLOW TURBINE

[75] Inventors: Carsten Mumm; Andreas Weiss, both of Waldshut-Tiengen, Germany

[73] Assignee: ABB Alstom Power (Switzerland) Ltd, Baden, Switzerland

[21] Appl. No.: 09/190,366

[22] Filed: Nov. 12, 1998

[30] Foreign Application Priority Data

Nov. 17, 1997 [EP] European Pat. Off. ..... 97810873

[51] Int. Cl.[7] ..... F01D 1/02

[52] U.S. Cl. ..... 415/192; 415/185; 415/208.2; 415/210.1

[58] Field of Search ..... 415/181, 185, 415/191, 192, 208.1, 208.2, 210.1

[56] References Cited

U.S. PATENT DOCUMENTS

| | | | |
|---|---|---|---|
| 4,470,755 | 9/1984 | Bessay | 415/191 |
| 4,826,400 | 5/1989 | Gregory | 415/181 |
| 5,249,922 | 10/1993 | Sato et al. | 415/191 |

FOREIGN PATENT DOCUMENTS

| | | |
|---|---|---|
| 0089600A1 | 9/1983 | European Pat. Off. . |
| 0260175A1 | 3/1988 | European Pat. Off. . |
| 0661413A1 | 7/1995 | European Pat. Off. . |
| 3743738A1 | 7/1988 | Germany . |
| 4228879A1 | 3/1994 | Germany . |
| 344800 | 4/1960 | Switzerland . |
| 1080015 | 8/1967 | United Kingdom . |
| 1116580 | 6/1968 | United Kingdom . |

*Primary Examiner*—Edward K. Look
*Assistant Examiner*—Ninh Nguyen
*Attorney, Agent, or Firm*—Burns, Doane, Swecker & Mathis, L.L.P.

[57] ABSTRACT

An output stage of an axial-turbine having a high channel divergence has a row of curved vanes and a row of narrowed twisted blades. The curved vanes include, in an axial direction, a positive sweep at their rotor-side end, head and a negative sweep at their stator-side end, with respect to a run of the rotor-side channel boundary. In an area of a stator-side channel boundary a negative sweepback predominates, so that between the curved vanes and the twisted blades an axial diffuser that steadily widens toward the stator-side channel boundary is formed. As a result, an increasing delay of an axial component of a flow agent can occur. The negative sweep at the stator-side end is formed such that at least one of a vane trailing edge and a vane leading edge is directed substantially perpendicularly to the stator-side channel boundary.

4 Claims, 1 Drawing Sheet

OUTPUT STAGE FOR AN AXIAL-FLOW TURBINE

BACKGROUND OF THE INVENTION

1. Field of the Invention

The invention relates to the output stage of an axial-flow turbine having high channel divergence, with a row of curved vanes and with a row of narrowed twisted blades.

2. Discussion of Background

Curved vanes are used, in particular, for reducing the secondary losses which occur as a result of the deflection of the boundary layers in the vanes.

Turbines with vanes curved only in the circumferential direction are known, for example, from DE-A-37 43 738. This shows and describes vanes, the curvature of which is directed, over the vane height, toward the pressure side of the vane which is, in each case, adjacent in the circumferential direction. This publication also discloses vanes, the curvature of which is directed, over the vane height, toward the suction side of the vane which is, in each case, adjacent in the circumferential direction. Consequently, both radial and circumferentially running boundary layer pressure gradients are to be reduced effectively and, therefore, the aerodynamic vane losses minimized. Irrespective of the side of the adjacent vane toward which the curvature of this known vane is directed, at all events said curvature runs exactly in the circumferential direction. This means that, in the case of the cylindrical vanes illustrated, at least their leading edges lie in the same axial plane over the vane height.

Turbines having vanes curved in the axial direction and in the circumferential direction are known, for example, from DE-A-42 28 879. A fixed vane cascade is arranged upstream of the blade cascade. The number and the chord-to-pitch ratio of the vanes of said vane cascade are optimized in flow terms for full load. They give the flow the swirl necessary for entry into the blade cascade. The curvature of the vanes runs perpendicularly to the chord, this being achieved both in the circumferential direction and in the axial direction by means of a displacement of the profile sections. The curvature of the vanes is directed toward the pressure side of the vane which is, in each case, adjacent in the circumferential direction. This curvature is formed by a continuous arc which is at an acute angle to the vane carrier and to the hub. As a result of curvature perpendicular to the vane chord, the vane surface projected in the radial direction is greater than in the case of the known curvature in the circumferential direction. The radial force on the working medium is therefore increased; the latter is pressed onto the channel walls, with the result that the boundary layer thickness is reduced there.

SUMMARY OF THE INVENTION

The object on which the present invention is based, in an axial-flow turbine of the type mentioned initially, in particular one with a low hub ratio, is to provide a measure by which the breakaway of the flow from the hub can be avoided and by which a more uniform pressure distribution over the height of the blading can be attained.

The advantage of the invention is to be seen, inter alia, in that, by virtue of the improved inflow, a blade design with substantially lower torsion can be used.

BRIEF DESCRIPTION OF THE DRAWINGS

A more complete appreciation of the invention and many of the attendant advantages thereof will be readily obtained as the same becomes better understood by reference to the following detailed description when considered in connection of the accompanying drawings, wherein.

Only the elements essential for understanding the invention are shown. For example, the blade feet, by means of which the blades are suspended in their carrying parts, and possible blade cover plates for improving the sealing effect are not illustrated. The direction of flow of the working medium is designated by arrows.

DESCRIPTION OF THE PREFERRED EMBODIMENT

Figure 1:
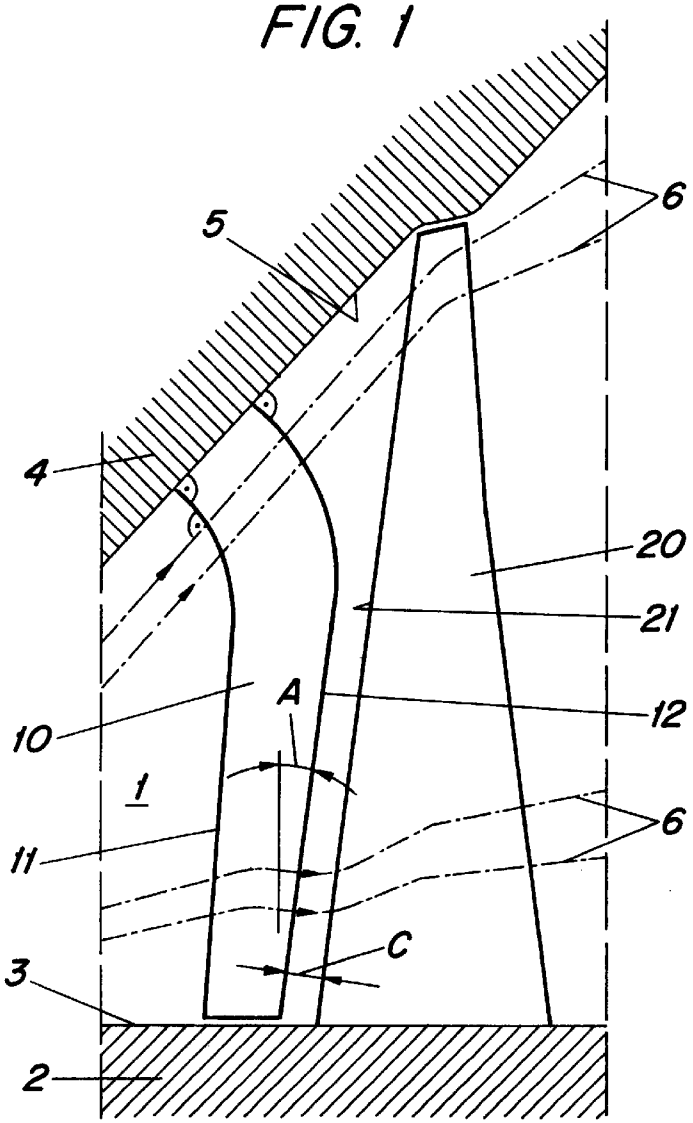
FIG. 1 shows a part longitudinal section through the turbine.

Referring now to the drawings, wherein like reference numerals designate identical or corresponding parts throughout the several views, in the steam turbine shown diagrammatically in FIG. 1 the walls delimiting the flow channel 1 are, on the one hand, the rotor-side channel boundary 3 and, on the other hand, the stator-side channel boundary 5. The output stage consists of a row of vanes 10 and of a row of blades 20. The vanes are fastened in the stator 4 in a way not illustrated, the vane carrier itself being suspended in a suitable way in an outer casing. The blades 20 are fastened in the rotor 2 in a way not illustrated. The blade leaf is narrowed and highly twisted in its longitudinal extent. The blade leaf seals off with its tip relative to the stator-side channel boundary 5.

In the entire region of the blading, the rotor-side channel boundary 3 is cylindrical, whilst, due to the increase in volume of the expanding working medium, the stator-side channel boundary 5 is designed conically and, in the case of high-load machines, may have an opening angle of up to 60°. It goes without saying that the inner channel contour may also be designed conically.

According to the invention, the vanes 10 have, in the axial direction, a positive sweep at their rotor-side end, head, and a negative sweep at their stator-side end. In this case, the sweep, which affects both the vane leading edge 11 and the vane trailing edge 12, relates to the cylindrical run of the rotor-side channel boundary 2. The sweep angle A is selected in such a way that the vane trailing edge 12 runs at least approximately parallel to the leading edge 21 of the blade 20. This positive sweep extends up to approximately ⅔ of the vane height. It gives rise to a force on the flow, said force acting radially toward the rotor-side channel boundary 3, as may be seen from the run of the meridian flow lines 6.

With respect to the rotor-side channel contour, the positive sweep merges into a negative sweep from approximately ⅔ of the vane height. Said negative sweep is selected in such a way that, at the stator-side end, the vane trailing edge 12 and the vane leading edge 11 are directed at least approximately perpendicularly to the flow-limiting wall 5. This measure ensures that, in the region of the stator, the flow lines 6 strike the vane leading edge 11 perpendicularly.

It can thus be seen that the nonrectilinear and nonradially running entry and exit edges of the vanes make it possible to implement an aerodynamically optimum vane width.

Moreover, the selected contour of the vane trailing edge 12, said contour being adapted to the run of the blade leading edge 21, makes it possible, in the lower ⅔ of the flow channel, to set the radially variable optimum length of the bladeless axial diffuser between the vane row and blade row. In the example, this axial diffuser, which occurs in the bladeless space as a result of the high channel divergence, has a width C. The narrower this axial diffuser is designed, the more beneficial is the effect of this on the design of the following blade. The less the flow medium is delayed in its axial component in this region, the larger the stagger angle of the following blade profile must be selected. The result of this, over the blade height under consideration, is that the blade leaf as a whole has to be twisted to a lesser extent.

Exactly the opposite result is obtained in the region of the stator-side channel boundary, where a negative sweep prevails. Here, in the last third of the blade height, an axial diffuser widening continuously toward the wall, and with an increase in delay of the axial component of the flow medium, occurs between the vanes and blades. The consequence of this is that the stagger angle of the following blade profile must be selected so as to be increasingly smaller. The result of this, in turn, over the blade height under consideration, is that the blade leaf as a whole has to be twisted to a lesser extent.

A positive and a negative sweep angle, together, of the vane thus result in a following blade having a radially optimum twist distribution, this also having a beneficial effect on the strength of the blade.

Figure 2:
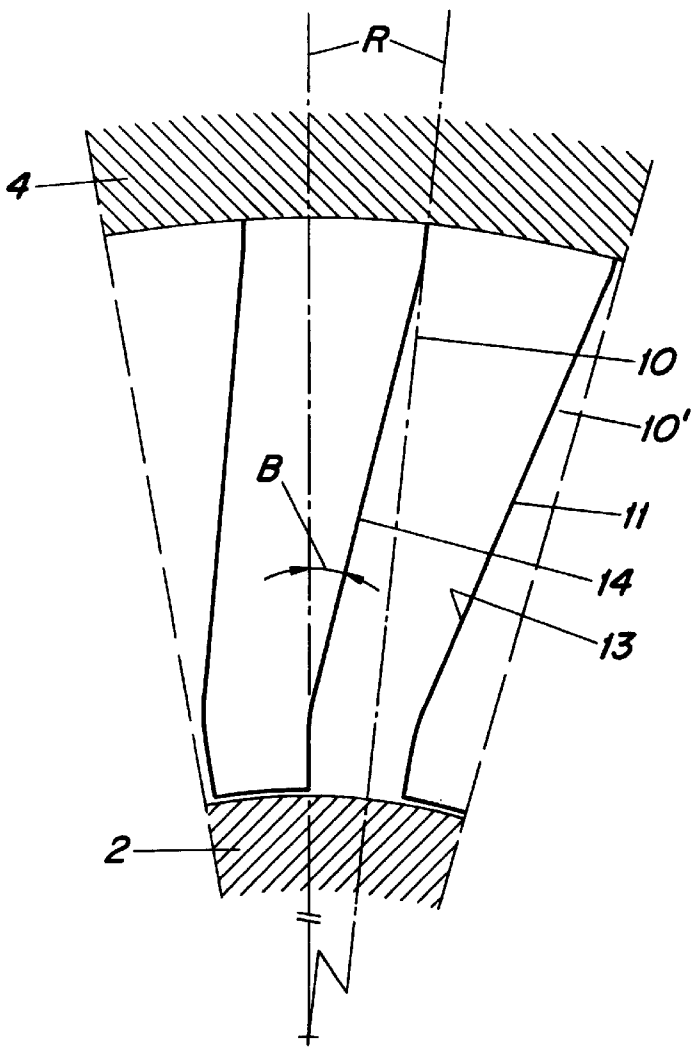
FIG. 2 shows a part cross section through the turbine.

FIG. 2 shows a further measure which has an advantageous effect on the displacement of the flow toward the rotor-side channel boundary. For this purpose, the vanes 10 lean in a circumferential direction over a large part of their radial extent, specifically in such a way that the lean is directed toward the suction side 13 of the vane 10' which is, in each case, adjacent in the circumferential direction. The vane is directed radially at its rotor-side end. From approximately 15% of the radial extent, said vane leans in the circumferential direction and returns to the radial R again at its stator-side end. It has been shown that a lean angle B relative to the radial R in the range of 10–17°, preferably 12–15°, generates a sufficiently high force on the flow, said force acting radially toward the rotor, and presses said flow toward the rotor.

Obviously, numerous modifications and variations of the present invention are possible in light of the above teachings. It is therefore to be understood that, within the scope of the appended claims, the invention may be practiced otherwise and is specifically described herein.

What is claimed as new and desired to be secured by Letters Patent of the United States is:

1. An output stage of an axial-flow turbine comprising: a row of curved vanes and a row of narrowed twisted blades, the curved vanes having, in an axial direction, a positive sweep at their rotor-side end, head, and a negative sweep at their stator-side end, with respect to a run of the rotor-side channel boundary, and that in an area of a stator-side channel boundary a negative sweepback predominates, so that between the curved vanes and the twisted blades an axial diffusor that steadily widens toward the stator-side channel boundary is formed such that an increasing delay of an axial component of a flow agent can occur, and wherein the negative sweep at the stator-side end is formed such that at least one of a vane trailing edge and a vane leading edge is directed substantially perpendicularly to the stator-side channel boundary.

2. The output stage as claimed in claim 1, wherein the positive sweep of the vanes at a trailing edge runs parallel to a leading edge of the blades over a large part of a radial extent.

3. An output stage of an axial-flow turbine comprising: a row of curved vanes and a row of narrowed twisted blades, the curved vanes having, in an axial direction, a positive sweep at their rotor-side end, head, and a negative sweep at their stator-side end, with respect to a run of the rotor-side channel boundary, and that in an area of a stator-side channel boundary a negative sweepback predominates, so that between the curved vanes and the twisted blades an axial diffusor that steadily widens toward the stator-side channel boundary is formed such that an increasing delay of an axial component of a flow agent can occur, and the vanes being directed radially at a rotor-side end and lean in a circumferential direction starting from approximately 15% of their radial extent and then lean back again substantially into the radial direction at a stator-side end and the lean being directed toward a suction side of an adjacent vane which is adjacent in the circumferential directions.

4. The output stage as claimed in claim 3, wherein a lean angle (B) relative to the radial direction is approximately 12–15°.

* * * * *